United States Patent [19]

Stover et al.

[11] 4,429,845

[45] Feb. 7, 1984

[54] RAIL TRACK HEATERS

[75] Inventors: John C. Stover, Verona; Paul J. Borkoski, North Huntingdon, both of Pa.

[73] Assignee: Emerson Electric Co., St. Louis, Mo.

[21] Appl. No.: 371,669

[22] Filed: Apr. 26, 1982

[51] Int. Cl.[3] ..... E01B 7/24

[52] U.S. Cl. ..... 246/428; 104/280; 191/27; 219/213; 219/536; 219/541

[58] Field of Search ..... 219/213, 536, 537, 541, 219/552; 246/428; 338/214; 340/234; 138/33; 104/279, 280; 126/271.2 B; 174/102 R; 191/27

[56] References Cited

U.S. PATENT DOCUMENTS

| | | | |
|---|---|---|---|
| 1,524,223 | 1/1925 | Wells | 246/428 |
| 1,957,977 | 5/1934 | Pacher | 246/428 |
| 1,959,107 | 5/1934 | Packer | 219/213 X |
| 1,991,801 | 2/1935 | Greenfield | 246/428 |
| 2,009,979 | 7/1935 | Abbott | 219/213 X |
| 2,090,156 | 8/1937 | Scholz | 246/428 X |
| 2,500,399 | 3/1950 | Broome | 246/428 X |
| 3,146,977 | 9/1964 | Coates et al. | 246/428 |
| 3,243,573 | 3/1966 | Weisse et al. | 219/213 |
| 4,051,466 | 9/1977 | Protze | 340/234 |
| 4,195,805 | 4/1980 | Keep et al. | 246/428 |

FOREIGN PATENT DOCUMENTS

| | | | |
|---|---|---|---|
| 1917471 | 4/1969 | Fed. Rep. of Germany | 246/428 |
| 89257 | 3/1957 | Norway | 246/428 |
| 98195 | 4/1961 | Norway | 246/428 |

*Primary Examiner*—Volodymyr Y. Mayewsky
*Attorney, Agent, or Firm*—Michael Williams

[57] ABSTRACT

Rail track heaters, comprising metal sheathed electric heaters, adapted to be positioned for heating a third rail or a switch rail. Our invention includes a simple stamping to provide a bracket for holding a cover containing the heater and surrounding insulation in position on the rail, and the same type of bracket made to be used to hold the terminal assembly of the heater in position on the rail. Each of the brackets is firmly held to the rail by a bolt extending transversely of and underneath the rail, the bolt having a hook at one end to hook over an adjoining part of the rail flange at one side of the rail, and having its other end adapted to engage a bracket part at an adjoining portion of the rail flange at the opposite side of the rail.

5 Claims, 5 Drawing Figures

RAIL TRACK HEATERS

BACKGROUND AND SUMMARY

The heating of rails, either third rails or rails in a switching area, is not novel. U.S. Pat. No. 4,195,805, issued Apr. 1, 1980, to Henry W. Keep, illustrates electric heaters adapted for heating the rails of a railroad switch. Such construction includes two fixed rails along which a train runs, and two switch rails movable laterally toward or away from the fixed rails to permit the train to either run along the fixed rails or to switch therefrom to a siding or the like.

U.S. Pat. No. 1,524,223, issued Jan. 27, 1925, to Loren S. Wells, illustrates electric heaters adapted for heating the third rail of the electrical power system for electrified trains.

Each of the two types of heaters mentioned above requires an individual means for attaching the electric heater to its rail. Our invention provides means for fastening the heater substantially at the neutral axis of the rail so that the heater is adapted for either switch rail or third rail heating purposes. Thus, the rails are maintained free of snow and ice in wintery climates so that they may function effectively. The fastening means includes under-the-rail clamping bolts so that the rail need not be drilled or have a stud welded to it.

DESCRIPTION OF THE DRAWINGS

In the drawings accompanying this specification and forming a part of this application, there is shown, for purpose of illustration, an embodiment which our invention may assume, and in these drawings.

DESCRIPTION OF THE PREFERRED EMBODIMENT

Figure 1:
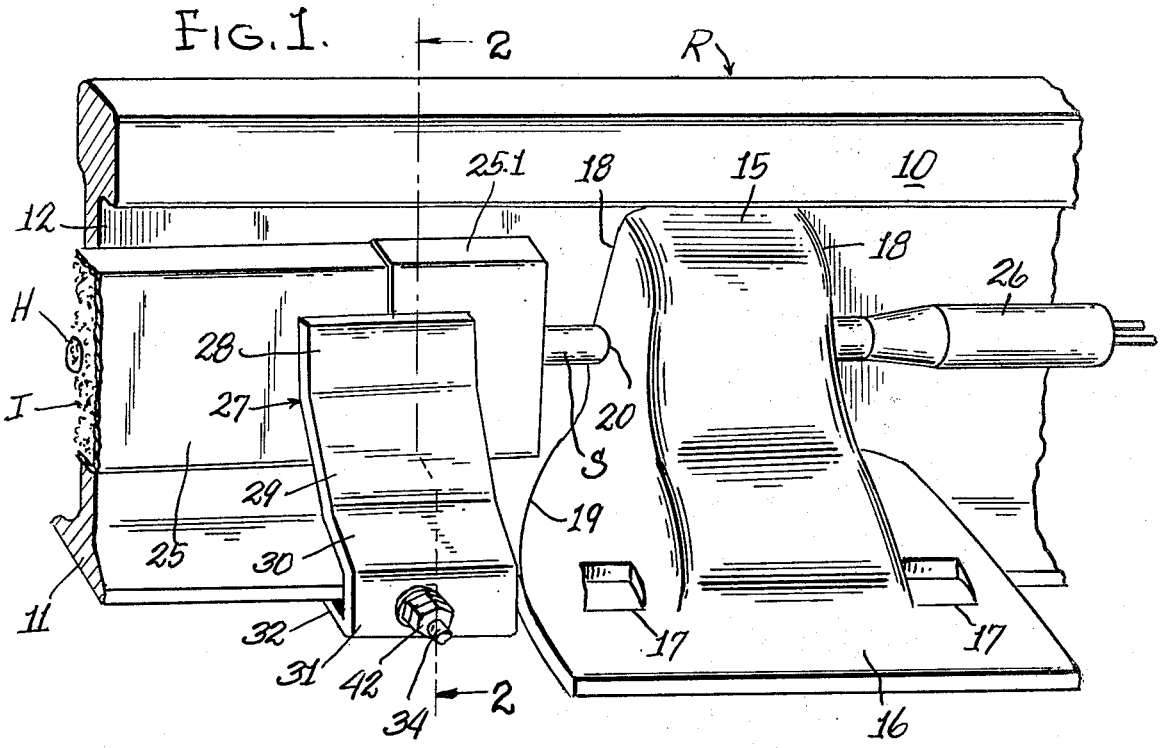
FIG. 1 is a fragmentary perspective view showing our improved apparatus for connecting a cover to a rail, the cover containing insulating material which surrounds the heater.

The rail R shown in the drawings is of conventional construction and includes a head 10, a base flange 11, and a web 12 integrally connecting the head and base flange. The electric heating element H is of the tubular, metal sheathed type made and sold by the Edwin L. Wiegand Division of Emerson Electric Co., under the Chromalox trademark. The heater is preferably of the type wherein both terminals are at a single end, although terminals at each end may also be used, it being necessary to wire accordingly.

Figure 4:
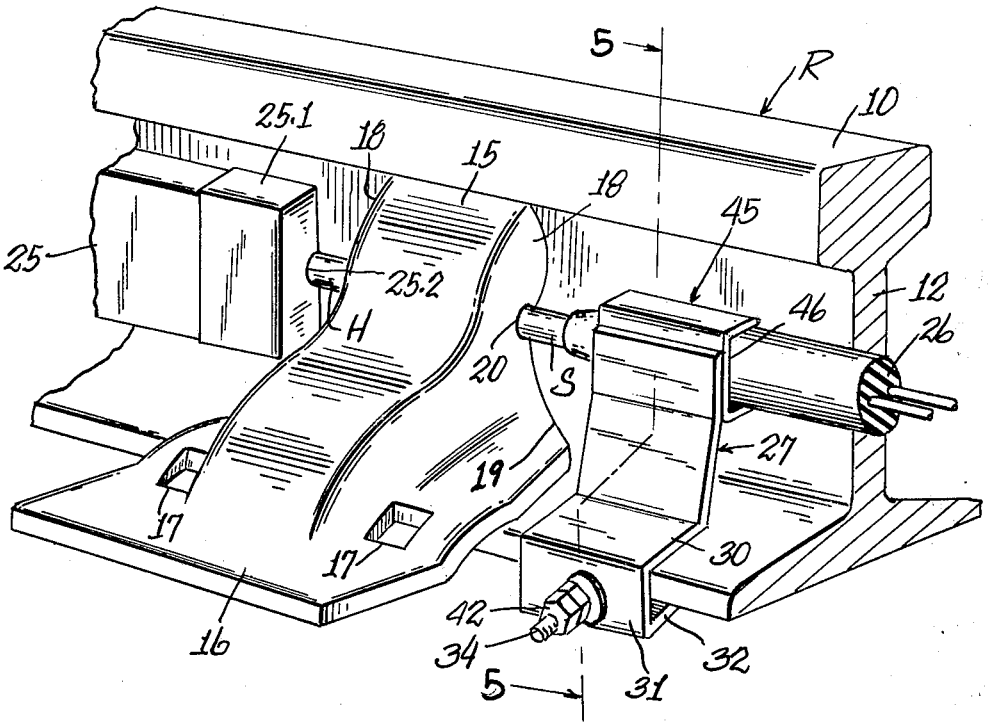
FIG. 4 is a fragmentary perspective view showing our improved apparatus for connecting the heater terminal assembly to a rail.

The rails are held to wooden ties by spikes driven into the ties, each spike having a head which overlies the base flange of the rail. This is a well-known construction in the railway art and is therefore not shown. Further, as in usual practice, the rails along which a train runs are braced against undue lateral movement to withstand shock of the moving train. Braces of types that may be used are shown in FIGS. 1 and 4, and are in the form of a forging having a head 15 adapted to bear against the web 12 of a rail R near the head 10, the forging having a base flange 16 formed with holes 17 to pass spikes which are driven into the railroad ties in the usual manner. The head is hollow and has spaced sides 18 having marginal edges 19 which conform to the shape of the rail web 12 and the adjoining portion of the rail flange 11. A notch 20 is cut in each marginal edge 19 to pass the sheath S of the electric heating element H.

Figure 2:
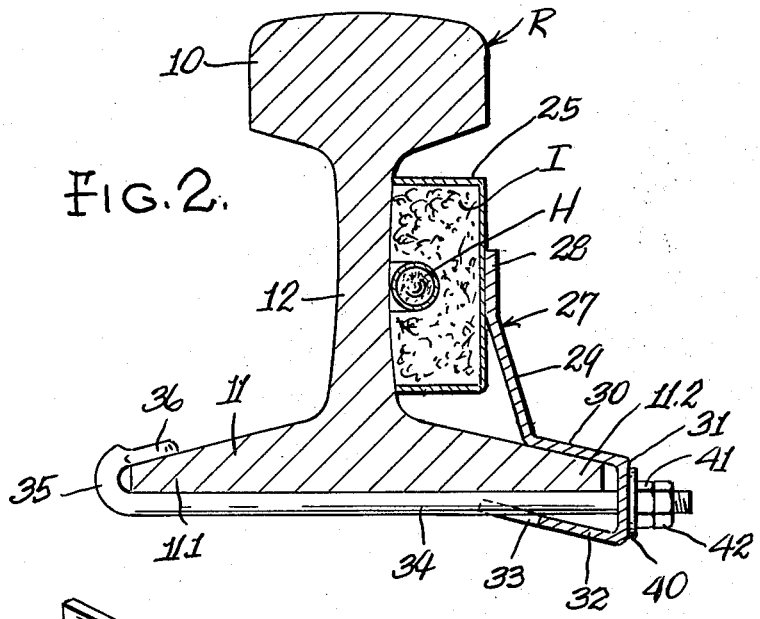
FIG. 2 is an enlarged, transverse sectional view corresponding generally to the line 2—2 of FIG. 1.

The braces may be spaced about fifteen feet apart (about 4.57 meters) and the sheath S of the heating element may be longer, since the notches 20 in the braces will pass the heating element. As seen in FIG. 2, the heating element is held against the adjoining surface of the web 12 of the rail in any suitable manner, such as by a bracket (not shown) or by the margins of the notches 20 in the braces.

In order to decrease heat loss to the atmosphere and thus increase the efficiency of the electric heater, insulation I is held about the sheath S at its active heating length, the insulation being held in place by means of a thin sheet metal channel-shaped cover 25 which is cut to length at the rail site to fit between track braces. The insulation I is preferably cellular and may be of any commercially available type. The terminals of the electric heater are contained within a tubular rubber boot 26 in customary manner, and this boot is held stationary in the manner shown in FIGS. 4 and 5. The cover has closures 25.1 at opposite ends, only one closure being shown in FIG. 4. The end closures are for the purpose of confining the insulating material, and each has a notch 25.2 to pass the sheath of the heating element.

Figure 3:
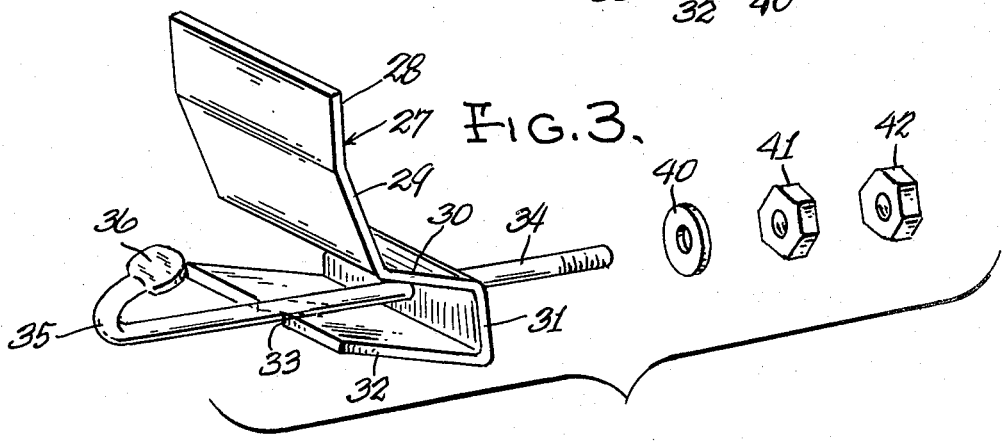
FIG. 3 is a perspective view of a bracket and bolt forming part of the means for connecting either the heater cover or the heater terminal assembly to a rail.
Figure 5:
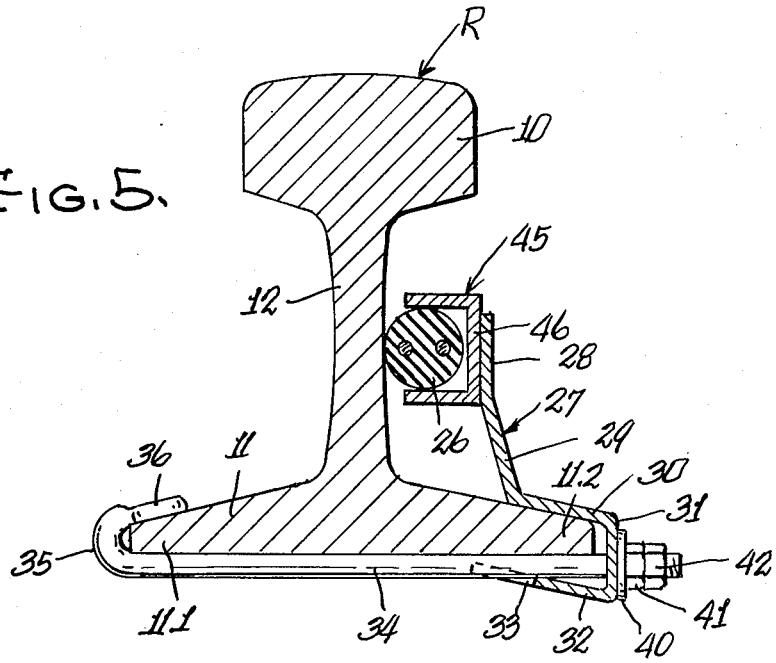
FIG. 5 is an enlarged transverse sectional view corresponding generally to the line 5—5 of FIG. 4.

A bracket 27 is shown in perspective in FIG. 3, and is preferably formed as a sheet metal stamping from 12 gauge aluminized steel. This type of bracket may be used to hold either the cover 25 or the boot 26 in position on the rail web. As best seen in FIGS. 2, 3 and 5, the bracket comprises an upper vertical portion 28, which merges at its lower portion with a slightly inclined portion 29, and the latter merges with a portion 30 which is slightly inclined upwardly from the horizontal. The portion 30 forms the upper leg of a U-shaped clamp having also a web 31 and a lower leg 32. The lower leg has a centrally located slot 33 for a purpose to appear.

The web 31 of the clamp has a hole to pass the threaded end of an elongated bolt 34. The bolt underlies and abuts the base flange 11 of the rail, as best seen in FIGS. 2 and 5, and has a hook end 35 which hooks over the terminal part 11.1 of the base flange. The upper part of the hook 35 is flattened, as shown at 36, to lie flat against the flat upper surface of part 11.1 to restrict the bolt against turning on its longitudinal axis. The U-shaped clamp portion of the bracket 27 fits over and around the terminal part 11.2 of the base flange 11, as best seen in FIGS. 2 and 5, with the defining margins of the slot 33 straddling the bolt 34 so as to combine with the upper legs 30 of the clamp to restrict rocking action of the bracket 27 about the bolt. A washer 40 is disposed over the threaded end of the bolt and a nut 41 is drawn up on the bolt to firmly hold the base flange 11 between the bolt hook 35 and the clamp portion of the bracket 27. An additional nut 42 may be threaded on the bolt to lock the nut 41 against any loosening action.

As seen in FIG. 2 the upper vertical portion 28 of the bracket 27 bears against the web of the channel-shaped cover 25 to firmly press the legs of the cover against the web 12 of the rail R. Several brackets 27 may be spaced along the length of the cover 25 to properly hold the latter in place, it being only necessary to insure that the bolt 34 is clear of a railroad tie.

As shown in FIG. 5, the very same bracket and bolt combination may be used to hold the terminal boot 26 in place. In this instance, a channel-shaped member in the form of a U-shaped clip 45 is provided to closely receive the boot. The clip is also formed as a sheet metal stamping from 12 gauge aluminized steel. Preferably, the web 46 of the clip 45 is secured to the upper vertical portion 28 of the bracket 27, as by welding or the equivalent so as not only to press the boot 26 against the rail web 12, but also to hold the boot against substantial vertical movement.

I claim:

1. Heating means for a railway rail, said rail having a head, a base flange and a web integrally connecting said base flange and head, the improvement comprising:

an elongated, tubular, metal-sheathed electric heating element held in position parallel to said rail and against a side surface of said web and operable to heat the same, a channel-shaped, sheet metal cover transversely encompassing a length of said element, a bracket holding said channel-shaped cover in position, including an upper vertical portion in engagement with the outer surface of a side of said cover, said bracket having a U-shaped portion fitting around a transverse terminal portion of said base flange, the web of said U-shaped portion having a hole therethrough, an elongated bolt underlying said base flange and having a threaded end extending through the hole in said U-shaped portion and having an opposite hook-shaped end adapted to hook around a transverse terminal portion of said base which is opposed to said first-named transverse portion, and a nut threaded on said bolt threaded end and operable to draw the hook-shaped bolt end and said bracket together to clamp said base flange therebetween and urge said upper vertical portion of said bracket and said channel-shaped cover against which it bears in a direction toward said web side.

2. The construction according to claim 1 wherein said heating element has an insulating boot around its terminal portion and wherein said channel-shaped member closely receives said boot to hold the latter against vertical movement and against movement in a direction away from said rail side web.

3. The construction according to claim 2 wherein the web of said channel-shaped member is welded to said bracket upper vertical portion.

4. Heating means for a railway rail, said rail having a head, a base flange and a web integrally connecting said base flange and said head, the improvement comprising:

an elongated tubular metal-sheathed electric heating element held in position parallel to said rail and against a side surface of said web, and operable to heat the same, a channel-shaped sheet metal cover transversely encompassing a length of said element, thermal insulating material confined within said cover to restrict loss of heat from said element to the atmosphere, a bracket holding said channel-shaped cover in position, including an upper vertical portion in engagement with the outer surface of a side of said cover, said bracket having a U-shaped portion fitting around a transverse terminal portion of said base flange, the web of said U-shaped portion having a hole therethrough, an elongated bolt underlying said base flange and having a threaded end extending through the hole in said U-shaped portion and having an opposite hook-shaped end adapted to hook around a transverse terminal portion of said base flange which is opposed to said first-named transverse portion, and a nut threaded on said bolt threaded end and operable to draw the hook-shaped bolt end and said bracket together to clamp said base flange therebetween and urge said upper vertical portion of said bracket and said channel-shaped cover against which it bears in a direction toward said web side.

5. The construction according to claim 4 wherein said upper vertical portion of said bracket bears against the web of said channel-shaped member to hold the terminal portions of the legs of said channel-shaped member against said rail web side.

* * * * *